US011649131B2

(12) United States Patent
Makita et al.

(10) Patent No.: US 11,649,131 B2
(45) Date of Patent: May 16, 2023

(54) POST-PROCESSING APPARATUS

(71) Applicant: FUJIFILM Business Innovation Corp., Tokyo (JP)

(72) Inventors: Takuya Makita, Kanagawa (JP); Hiroshi Kato, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 15 days.

(21) Appl. No.: 17/387,985

(22) Filed: Jul. 28, 2021

(65) Prior Publication Data

US 2022/0259000 A1 Aug. 18, 2022

(30) Foreign Application Priority Data

Feb. 17, 2021 (JP) ..... JP2021-023642

(51) Int. Cl.
*B65H 31/20* (2006.01)
*B65H 31/30* (2006.01)

(52) U.S. Cl.
CPC ... *B65H 31/3063* (2013.01); *B65H 2301/121* (2013.01); *B65H 2511/15* (2013.01); *B65H 2801/27* (2013.01)

(58) Field of Classification Search
CPC ..... B65H 31/18; B65H 31/3063; B65H 2301/121; B65H 2511/15; B65H 2801/27
USPC ..... 270/32, 37, 58.13, 58.28
See application file for complete search history.

(56) References Cited

U.S. PATENT DOCUMENTS 5,032,876 A * 7/1991 Murakami ..... B65H 31/18 399/410
6,076,825 A * 6/2000 Kato ..... B65H 31/00 271/213
6,231,039 B1 * 5/2001 Chung ..... B65H 31/3018 270/58.12
6,712,349 B2 * 3/2004 Watanabe ..... B65H 31/12 412/18
7,489,898 B2 * 2/2009 Hayashi ..... B65H 45/18 399/407
7,681,881 B2 * 3/2010 Kunieda ..... B65H 31/38 271/220
7,862,027 B2 * 1/2011 Dobashi ..... B65H 29/6645 270/32
8,419,008 B2 * 4/2013 Ikeda ..... B65H 1/14 271/31
8,733,751 B2 * 5/2014 Kagami ..... G03G 15/6552 270/32

(Continued)

FOREIGN PATENT DOCUMENTS

JP 2015078031 4/2015

*Primary Examiner* — Leslie A Nicholson, III
(74) *Attorney, Agent, or Firm* — JCIPRNET

(57) ABSTRACT

A post-processing apparatus includes: a processing unit configured to pull in a recording medium transported from an upstream apparatus and perform processing on the recording medium; a discharge unit to which the recording medium processed by the processing unit is discharged; and a lifting drive device configured to, in a case where a folded recording medium is pulled into the processing unit, move the discharge unit downward such that a height of the discharge unit is lower than a height of the discharge unit in a case where an unfolded recording medium is pulled into the processing unit.

9 Claims, 5 Drawing Sheets

(56) References Cited

U.S. PATENT DOCUMENTS 9,340,390 B2 5/2016 Ishikawa et al.
9,610,795 B2 * 4/2017 Sato ..... B65H 37/04

* cited by examiner

POST-PROCESSING APPARATUS

CROSS-REFERENCE TO RELATED APPLICATIONS

This application is based on and claims priority under 35 USC 119 from Japanese Patent Application No. 2021-023642 filed Feb. 17, 2021.

BACKGROUND

(i) Technical Field

The present invention relates to a post-processing apparatus.

(ii) Related Art

JP2015-78031A discloses a sheet processing apparatus that performs processing of folding a sheet into a Z shape, the sheet being received from an image forming apparatus such as a copier or a printer, once pulls the folded sheet into a compile tray from a transport path to perform staple processing, and then discharges the stapled sheet to a stacker tray.

SUMMARY

Aspects of non-limiting embodiments of the present disclosure relate to a post-processing apparatus in which a rear end in a transport direction of a folded recording medium to be loaded on a processing unit is sent to a processing position of the processing unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a post-processing apparatus that includes: a processing unit configured to pull in a recording medium transported from an upstream apparatus and perform processing on the recording medium; a discharge unit to which the recording medium processed by the processing unit is discharged; and a lifting drive device configured to, in a case where a folded recording medium is pulled into the processing unit, move the discharge unit downward such that a height of the discharge unit is lower than a height of the discharge unit in a case where an unfolded recording medium is pulled into the processing unit.

BRIEF DESCRIPTION OF THE DRAWINGS

Exemplary embodiment(s) of the present invention will be described in detail based on the following figures, wherein.

DETAILED DESCRIPTION

Figure 1:
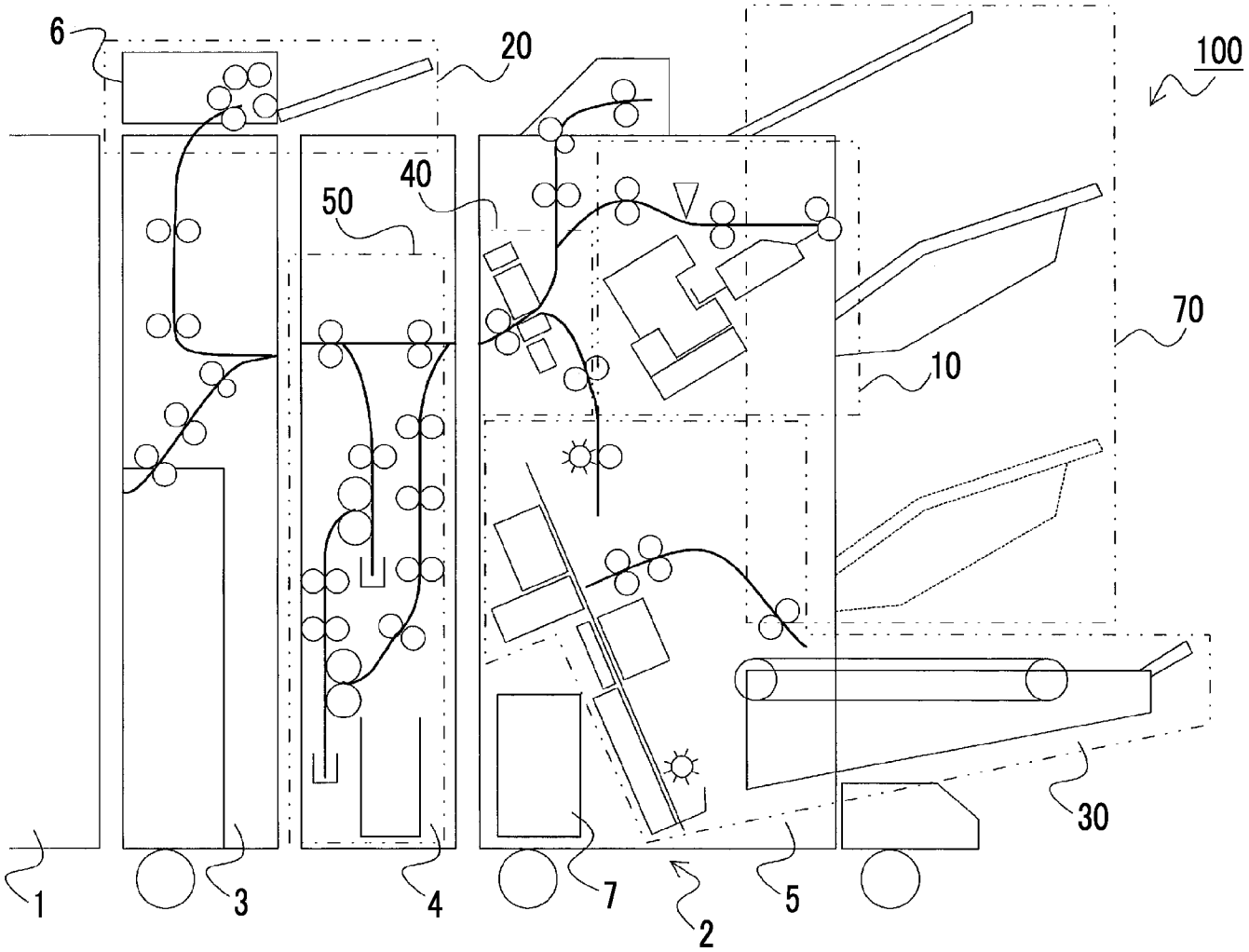
FIG. 1 shows an overall configuration of an image forming system including a post-processing apparatus according to an exemplary embodiment of the present invention.

FIG. 1 shows an overall configuration of an image forming system 100 including a post-processing apparatus according to an exemplary embodiment of the present invention. The image forming system 100 includes an image forming apparatus 1 that forms a color image on a sheet as a recording medium by, for example, an electrophotographic method. Further, the image forming system 100 includes a sheet processing apparatus 2 that performs various kinds of predetermined processing on the sheet sent from the image forming apparatus 1.

Here, the image forming apparatus 1 includes a photoreceptor drum configured to hold an electrostatic latent image, a charged body configured to charge the photoreceptor drum, a laser exposure device configured to form an electrostatic latent image by irradiating the photoreceptor drum with laser light, a developing device configured to develop the electrostatic latent image formed on the photoreceptor drum using toner, and a transfer device that transfers a toner image formed on the photoreceptor drum onto a sheet. The image forming apparatus 1 may be an image forming apparatus configured to form an image on a sheet by, for example, an inkjet method, in addition to an image forming apparatus configured to form an image on a sheet by an electrophotographic method.

The sheet processing apparatus 2 includes a transport unit 3 connected to the image forming apparatus 1, a folding unit 4, a finisher 5 configured to perform predetermined post-processing on the sheet that has passed through the folding unit 4, an interposer 6 configured to supply laminated paper such as the cover of a booklet, and a controller 7 configured to control each function of the sheet processing apparatus 2. Although the controller 7 is arranged in a housing of the finisher 5 in FIG. 1, the controller 7 may be arranged in a housing of another unit such as the transport unit 3 or the folding unit 4. The image forming apparatus 1 may be configured to integrate all the control functions.

The sheet processing apparatus 2 will be described separately from the viewpoint of function. The sheet processing apparatus 2 includes a staple function unit 10 which is provided in the finisher 5 and is configured to generate a sheet bundle and execute staple binding, a laminated paper function unit 20 which is configured to include the interposer 6 or the like and is configured to supply laminated paper such as thick paper or open window paper used for the cover of the sheet bundle, a saddle stitch binding function unit 30 which is provided in the finisher 5 and is configured to bind the sheet bundle by performing saddle stitching, a punch function unit 40 which is provided in the finisher 5 and is configured to punch two holes or four holes in the sheet, and a folding function unit 50 which is provided in the folding unit 4 and is configured to perform Z-folding and C-folding on the sheet. Further, a sheet loading function unit 70 in which the sheet is finally discharged and loaded is provided in the sheet processing apparatus 2. The post-processing apparatus of the invention includes the configuration of the staple function unit 10 and the configuration of the sheet loading function unit 70, but only a part of each configuration may be included in the post-processing apparatus, or all the configurations may be included in the post-processing apparatus.

The folding function unit 50 of the folding unit 4 performs Z-folding or C-folding on the sheet transported from the transport unit 3 on the upstream side, and transports the sheet to the finisher 5 arranged on the downstream side. Since the exemplary embodiment relates to the processing for the Z-folded sheet, the Z-folded sheet will be mainly described in the following description. Here, the Z-folding is processing in which a valley fold is made at the ¼ position from the front end of the sheet in the transport direction, a mountain fold is made at the ½ position from the front end of the sheet in the transport direction so that the sheet is bent twice such that the sheet has a Z shape in a case where the sheet is viewed from a direction orthogonal to the transport direction. The Z-folding is not limited to the processing in which the folds are formed at the ¼ position and the ½ position from the front end of the sheet in the transport direction. The Z-folding includes all the folds as long as the folds on the front end side of the sheet in the transport direction are not aligned with the rear end of the sheet, are on the front end side in the transport direction from the rear end of the sheet, and the folds on the front end side of the sheet in the transport direction are below the entire sheet.

In the exemplary embodiment, the transport direction of the sheet refers to the transport direction of the sheet in a case where the staple function unit 10 or the finisher 5 is viewed as a whole, the front end side in the transport direction refers to the right side of the paper surface of FIG. 1, and the rear side in the transport direction refers to the left side of the paper surface of FIG. 1. As the recording medium, a sheet made of paper having predetermined shape and dimensions will be described as an example. Examples of the sheet include, for example, A4 sheets, B4 sheets, A5 sheets and the like. The recording medium may not be the sheet made of paper, and may be a sheet-shaped recording medium made of cloth or plastic.

The sheet that has been Z-folded by the folding function unit 50 of the folding unit 4 is selectively punched with two holes or four holes in the punch function unit 40 of the finisher 5, and is transported to the staple function unit 10 and the sheet loading function unit 70 which constitute the post-processing apparatus on the downstream side. In a case where punching is not required, the sheet simply passes through the punch function unit 40 without being punched, and is transported to the staple function unit 10 on the downstream side.

The staple function unit 10 and the sheet loading function unit 70 of the exemplary embodiment will be described with reference to FIG. 2. The staple function unit 10 is configured to pull in the recording medium, that is, a sheet S, which has been transported from the upstream apparatus such as the folding function unit 50 and the punch function unit 40, and performs the staple processing. The staple function unit 10 includes a receiving roll 11 which is a pair of rollers for receiving the sheet S from the upstream apparatus. The staple function unit 10 includes a sensor 12 which is provided on the downstream side of the receiving roll 11 and detects the sheet S. Further, the staple function unit 10 includes a compile tray 13 configured to collect and accommodate a plurality of sheets S, and an exit roll 14 which is provided on the downstream side of a detection portion of the sheet S by the sensor 12 and is a pair of rollers for discharging the sheet S toward the compile tray 13.

Further, the staple function unit 10 includes a paddle 15 that is rotated to push the sheet S toward an end guide 13*b*, which will be described later, of the compile tray 13, and a tamper 16 that pushes the sheet S toward a side guide 13*c*, which will be described later, of the compile tray 13. The staple function unit 10 is an example of binding means, and includes a stapler 17 that binds the end portion of the bundle of sheets S accumulated on the compile tray 13 by using a staple needle. The staple function unit 10 includes a discharge roll 18 that pushes down the sheet S accumulated on the compile tray 13 and discharges the bundle of the stapled sheets S to a stacker tray 72 of the sheet loading function unit 70.

The sheet loading function unit 70 includes an opening 71 that allows the bundle of the sheet S to pass through and to be discharged, the stacker tray 72 that stacks the processed sheet bundle such that the user easily picks up the sheet bundle, and a lifting drive device 73 that moves the stacker tray 72 up and down in an up-down direction. The stacker tray 72 constitutes a discharge unit to which the sheet S stapled by the staple function unit 10 is discharged. As will be described later, in a case where the Z-folded sheet S is pulled in the compile tray 13 of the staple function unit 10, the lifting drive device 73 is configured to move the stacker tray 72 downward so that the height of the stacker tray 72 as the discharge unit is lower than the height of the stacker tray 72 in a case where the sheet S that has not been Z-folded is pulled in the compile tray 13.

The compile tray 13 includes a loading platform 13*a* that receives and loads the sheet from the exit roll 14, the end guide 13*b* that is formed on the surface of the loading platform 13*a* along a direction perpendicular to the transport direction of the sheet, and the side guide 13*c* that is formed on the surface of the loading platform 13*a* in a direction parallel to the transport direction of the sheet. The end guide 13*b* is a reference surface as a reference for aligning the end faces of the sheets on the rear end side in the transport direction in a case where the sheets discharged from the exit roll 14 are aligned, and the rear end faces of a plurality of sheets are abutted against the end guide 13*b* so that the positions of the sheets in the transport direction are aligned.

As will be described later, the sheet S is supplied toward the upper surface of the loading platform 13*a* of the compile tray 13 by being sent in a first traveling direction S1 of FIG. 2 after passing through the exit roll 14. Then, in a state where a part of the sheet S on the front end side in the transport direction passes through the opening 71 from above a drive-side discharge roll 18*a*, which will be described later, of the discharge roll 18 and is exposed to the outside, the traveling direction is reversed, and the sheet S falls along the upper surface of the loading platform 13*a* of the compile tray 13 in a second traveling direction S2 of FIG. 2, and the rear end of the sheet S in the transport direction reaches the end guide 13*b*.

Figure 2:
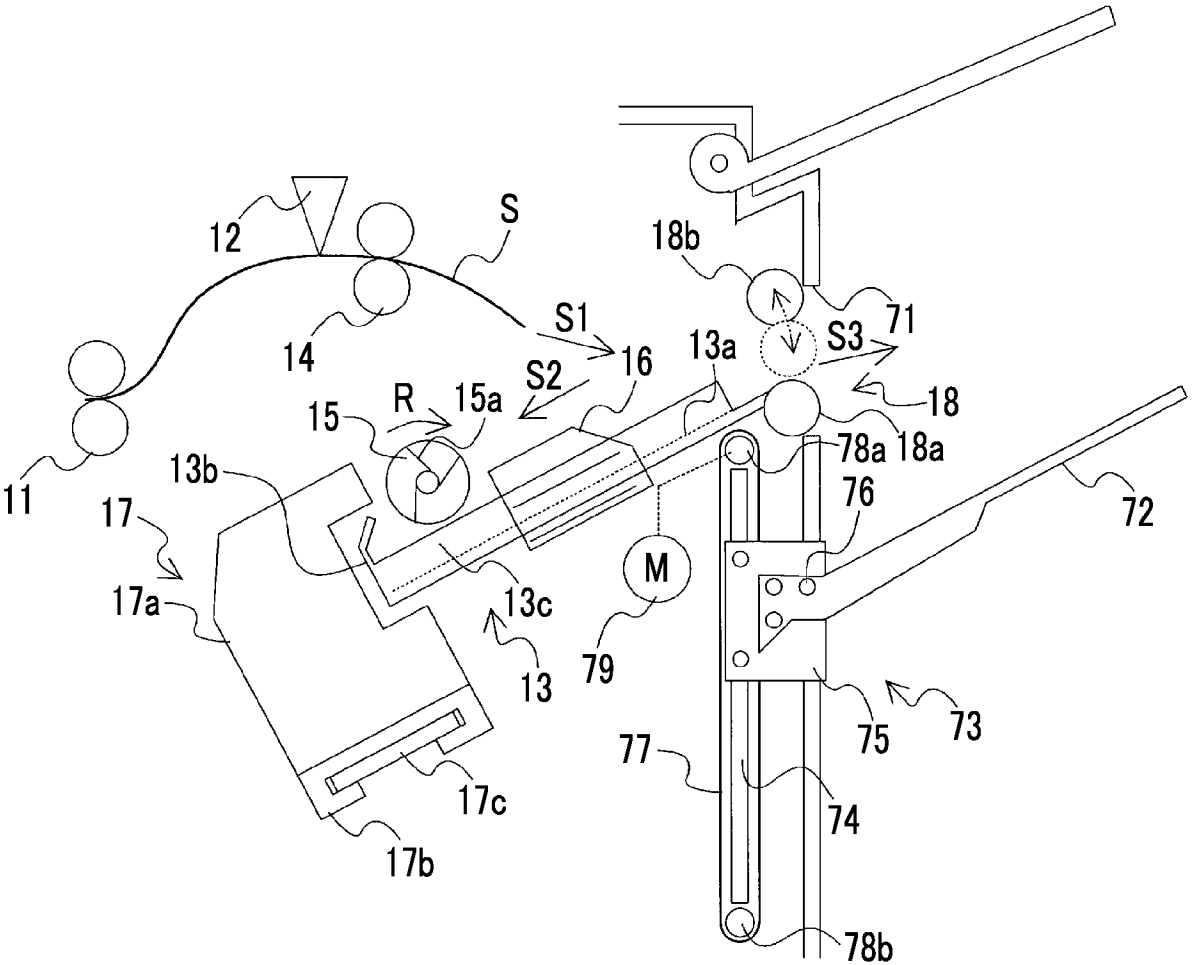
FIG. 2 shows a configuration of a staple function unit and a sheet loading function unit of the exemplary embodiment.

That is, the end guide 13*b* has a surface substantially orthogonal to the loading platform 13*a* on the rear end side of the sheet S that falls along the upper surface of the loading platform 13*a*, that is, on the left side of FIG. 2. That is, the end guide 13*b* is configured to align the rear end of the sheet S that falls along the loading platform 13*a*. On the other hand, the side guide 13*c* has a surface that extends in a direction substantially parallel to the falling second traveling direction S2 direction of the sheets S that falls along the loading platform 13*a*, and that is substantially orthogonal to the loading platform 13*a*. That is, the side guide 13*c* is configured to align one end portion of the sheet S, which is substantially parallel to the falling direction of the sheet S that falls along the loading platform 13*a*.

The paddle 15 has, for example, three flexible sheet contact portions 15*a*, and contacts the upper surface of the sheet S on the loading platform 13*a* or the uppermost surface of the bundle of sheets S to transport, that is, pull in the sheet toward the end guide 13*b*. The paddle 15 is rotated in an R direction of FIG. 2 to push the sheet S in the second traveling direction S2 on the loading platform 13*a*.

The tamper 16 is provided on a side surface that is one of the two side surfaces of the compile tray 13 and is opposite to the side surface on which the side guide 13*c* is provided, the two side surfaces being parallel to the transport direction of the sheet, and the tamper 16 is arranged such that the distance from the side guide 13*c* of the compile tray 13 is changed in response to the drive of a motor or the like. In the exemplary embodiment, the tamper 16 is provided on the back side of the paper surface of FIG. 2 with respect to the compile tray 13. The tamper 16 is moved in a direction orthogonal to the transport direction of the sheet so as to push the sheet S loaded on the compile tray 13 in a direction orthogonal to the transport direction of the sheet, to abut the side end of the sheet S against the side guide 13*c*, and to align the sheet S.

The stapler 17 performs binding processing, that is, staple processing by pushing the staple needles one by one into the bundle of sheets S accommodated on the compile tray 13. The stapler 17 is provided to be movable around the compile tray 13. Specifically, the stapler 17 includes a staple head 17*a* that actually performs the staple processing using the staple needle, a base 17*b* that supports the staple head 17*a*, and a rail 17*c* that is formed on the base 17*b* and forms a path where the staple head 17*a* is moved. The rail 17*c* is formed along the periphery of the compile tray 13. The base 17*b* and the staple head 17*a* are moved on the rail 17*c* using a stapler motor (not shown) as a drive source, and performs staple processing on the sheet at a user's desired position.

The stapler 17 that performs the staple processing on the sheet has been described as an example of the processing unit, but a binding processing apparatus that performs binding processing on the sheet without using the staple needle, or a processing apparatus that performs compiling processing of aligning the positions of the sheets without performing the binding processing may be used as a mechanism of the processing unit that performs processing on the sheet.

Next, the discharge roll 18 will be described. As shown in FIG. 2, the discharge roll 18 has the drive-side discharge roll 18*a* and a driven-side discharge roll 18*b*. The drive-side discharge roll 18*a* and the driven-side discharge roll 18*b* are arranged so as to be separated from each other.

The drive-side discharge roll 18*a* is rotatably supported by the housing of the finisher 5, and is fixedly supported by a rotary shaft that is rotationally driven by an eject motor (not shown).

The driven-side discharge roll 18*b* is supported by a swingable support member (not shown). As the support member swings, the driven-side discharge roll 18*b* swings between a contact position where the driven-side discharge roll 18*b* contacts the upper surface of the sheet S loaded on the loading platform 13*a* of the compile tray 13 and a retreat position, that is, a non-contact position where the driven-side discharge roll 18*b* retreats from the upper surface of the sheet S loaded on the loading platform 13*a* of the compile tray 13.

The driven-side discharge roll 18*b* is at the retreat position in a case where the sheet S is discharged from the exit roll 14 to the compile tray 13 and the rear end of the sheet S is aligned with the end guide 13*b*. In a case where the sheet S is discharged from the compile tray 13 to the stacker tray 72, the driven-side discharge roll 18*b* swings up to the contact position where the driven-side discharge roll 18*b* contacts the upper surface of the sheet S loaded on the loading platform 13*a* of the compile tray 13, and then, as the eject motor is rotated, the drive-side discharge roll 18*a* is rotated, and the driven-side discharge roll 18*b* is driven to be rotated. As a result, the sheet loaded on the compile tray 13 is moved in a direction S3 and is ejected onto the stacker tray 72. The discharge roll 18 is arranged on the rear side in the transport direction with respect to the front end of the sheet with a relatively short feed length from the end guide 13*b* of the loading platform 13*a*, for example, the A5LEF sheet, in the transport direction. That is, the distance from the end guide 13*b* to the discharge roll 18 is set to be shorter than the length of the short side of the A5 sheet.

Next, the opening 71 will be described. The opening 71 is an opening formed in the housing of the finisher 5, and is a region through which the bundle of sheets S discharged toward the stacker tray 72 by the discharge roll 18 passes.

Next, the lifting drive device 73 will be described. The stacker tray 72 is moved downward and upward by the lifting drive device 73. The downward movement and the upward movement by the lifting drive device 73 are controlled by the controller 7 shown in FIG. 1.

The lifting drive device 73 includes a guide 74 formed from the upper direction to the lower direction of the finisher 5, and a slide member 75 that slides downward or upward while being guided by the guide 74. The stacker tray 72 is fastened to the slide member 75 by fastening portions 76 provided at a plurality of places, for example, three places, and is moved downward or upward by the downward movement and the upward movement of the slide member 75.

The lifting drive device 73 includes a belt member 77 formed in an endless shape, and a first pulley 78*a* and a second pulley 78*b* which are arranged with a gap in the up-down direction, support the belt member 77 from the inside, and apply tension to the belt member 77. The lifting drive device 73 includes a motor 79 that drives the belt member 77 via the first pulley 78*a*. The slide member 75 is fixed to the belt member 77, and is moved in the up-down direction in conjunction with the movement of the belt member 77.

In a case where the controller 7 rotationally drives the motor 79 in the forward direction, the slide member 75 is moved downward in accordance with the movement of the belt member 77. As a result, the stacker tray 72 is moved downward. On the contrary, in a case where the controller 7 rotationally drives the motor 79 in the opposite direction, the slide member 75 is moved upward in accordance with the movement of the belt member 77. As a result, the stacker tray 72 is moved upward. These movements are controlled by the stepping operation of the motor 79.

Figure 3A:
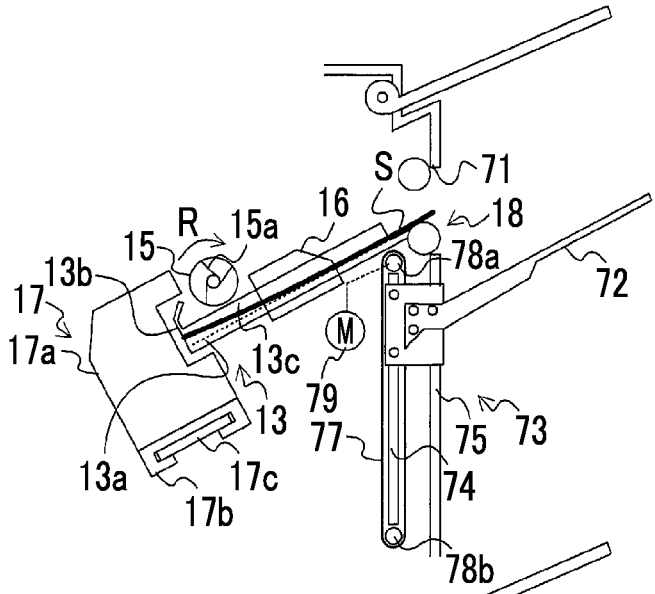
FIG. 3A shows a state in which a sheet having a short feed length is placed on a compile tray.

Next, the operations of the staple function unit 10 and the sheet loading function unit 70 included in the post-processing apparatus of the exemplary embodiment will be described with reference to FIGS. 3A to 5. First, for comparison, a state in which a sheet having a relatively short feed length is placed on the compile tray 13 will be described with reference to FIG. 3A. In FIG. 3A, the A5LEF sheet, that is, the long side of the A5 sheet is placed on the loading platform 13*a* of the compile tray 13 in a direction orthogonal to the transport direction. In this case, the rear end of the A5 sheet in the transport direction reaches the end guide 13*b* of the compile tray 13 due to the sheet's own weight and the rotation of the paddle 15 in the R direction. Further, in this case, the front end of the A5 sheet in the transport direction is located closer to the front end side in the transport direction than the drive-side discharge roll 18*a* of the discharge roll 18. In this manner, after the A5LEF sheet is stapled by the stapler 17, the A5LEF sheet having a short feed length is discharged to the stacker tray 72 by the rotation of the discharge roll 18.

Figure 3B:
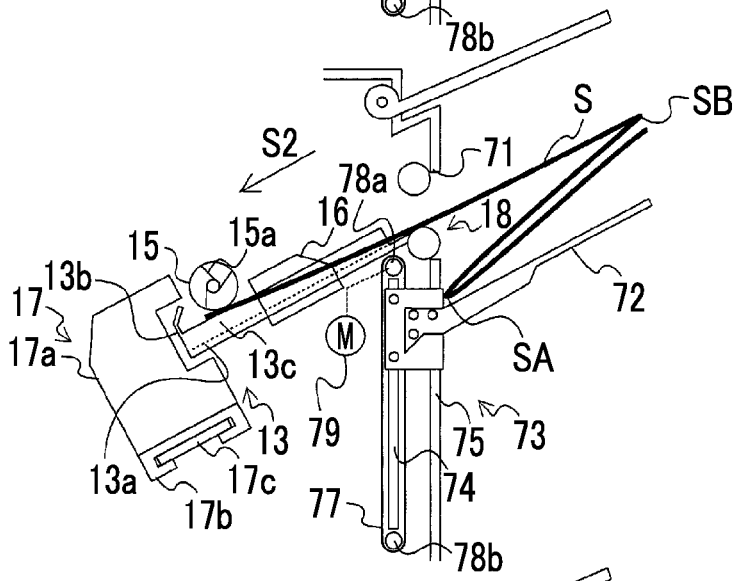
FIG. 3B shows a state in which a sheet which has a long feed length and is Z-folded is placed on the compile tray and a stacker tray is not moved downward.
Figure 3C:
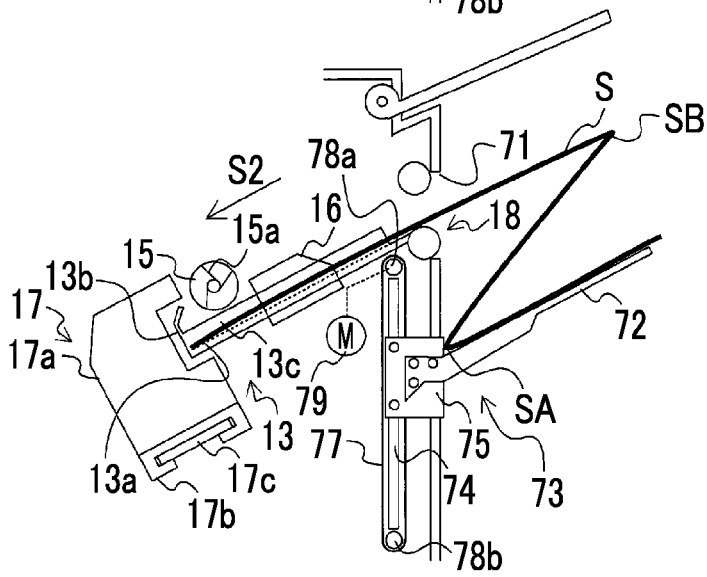
FIG. 3C shows a state in which a sheet which has a long feed length and is Z-folded is placed on the compile tray and the stacker tray is moved downward.

FIG. 3B illustrates a state in which a sheet having a relatively long feed length, for example, B4SEF, A3SEF, or LedgerSEF, that is, the short side of any sheet of the B4, A3, and Ledger sheet is transported in a direction orthogonal to the transport direction, is Z-folded, and is loaded on the loading platform 13*a* of the compile tray 13. In this case, since the feed length of the Z-folded sheet is long, the folds of the sheet S are located outside the discharge roll 18 and the opening 71.

That is, the sheet S is supplied toward the upper surface of the loading platform 13*a* of the compile tray 13 while passing through the exit roll 14, but in this case, folds SA and SB of the sheet S both reach the outside of the discharge roll 18 and the opening 71 at the time when the rear end of the sheet S in the transport direction has passed through the exit roll 14.

In this case, the paddle 15 is rotated and pulls the sheet S in the second traveling direction S2, that is, toward the end guide 13*b* of the compile tray 13. In this case, since the fold SA on the front end side of the sheet S in the transport direction is outside the opening 71, the fold SA is moved downward to the top of the stacker tray 72 due to the sheet's own weight. Then, the fold SA on the front end side in the transport direction is in a state of being caught in contact with the housing on the lower side of the opening 71, on the stacker tray 72. Therefore, in a case where the sheet S is pulled toward the end guide 13*b*, the fold SA pulls the sheet S toward the stacker tray 72, which prevents the rear end of the sheet S in the transport direction from reaching the end guide 13*b* of the compile tray 13.

Therefore, in the exemplary embodiment, in a case where the sheet which has a relatively long feed length and is Z-folded is pulled into the compile tray 13, the stacker tray 72 is moved downward by the lifting drive device 73. The state in which the stacker tray 72 is moved downward will be described with reference to FIG. 3C.

In a case where the stacker tray 72 is moved downward, the fold SA on the front end side of the Z-folded sheet S in the transport direction is moved downward together with the stacker tray 72. Then, the second fold SB from the front end side in the transport direction is opened. That is, the angle of the fold SB is increased. As a result, the force with which the first fold SA from the front end side in the transport direction pulls the sheet S toward the stacker tray 72 becomes small, and the second fold SB from the front end side of the sheet S in the transport direction is easily moved toward the end guide 13*b* of the compile tray 13.

In a case where the paddle 15 is rotated in this state, the rear end of the sheet S in the transport direction can be pulled up to the end guide 13*b* of the compile tray 13 in the second traveling direction S2, and the rear ends of the sheets S in the transport direction are aligned.

Figure 4:
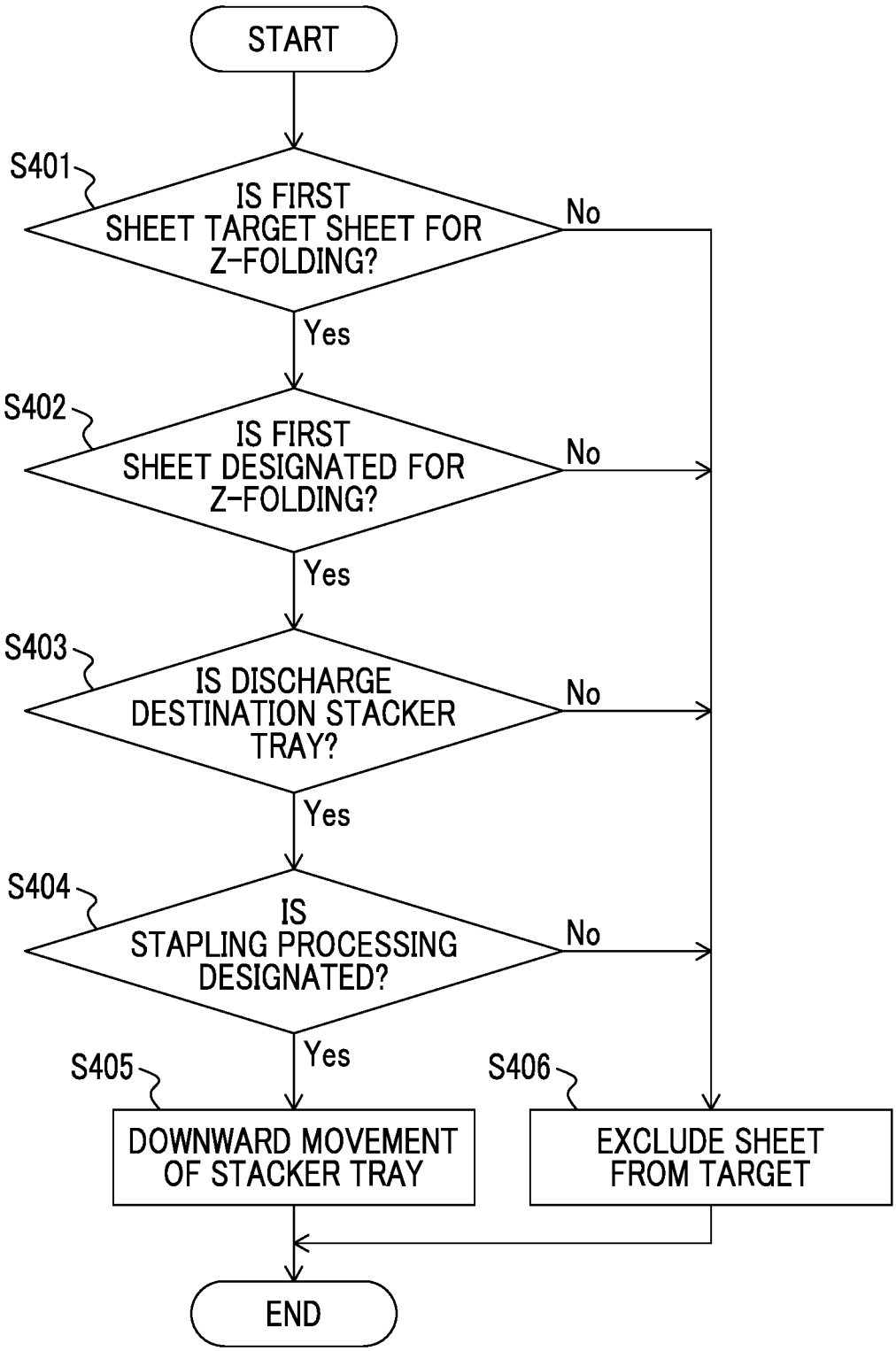
FIG. 4 is a flowchart showing a flow of processing of determining for which sheet downward movement processing of the stacker tray is to be performed.

With reference to FIG. 4, a method of determining for which sheet the downward movement processing of the stacker tray 72 described above is to be performed will be described. In Step S401 of FIG. 4, the controller 7 determines whether the first sheet of a print job, that is, one image forming processing unit is a target sheet for the Z-folding processing, for the sheet S supplied to the compile tray 13. Specifically, it is determined whether the sheet is a sheet having a feed length greater than a predetermined length, such as B4SEF, A3SEF, or LedgerSEF, and in a case where the sheet is the target sheet, the processing proceeds to Step S402. In a case where the sheet is Z-folded and the sheet has a length such that the first fold SA on the front end side in the transport direction is not placed on the loading platform 13*a* of the compile tray 13, the sheet may be regarded as the target sheet. In a case where the sheet is not the target sheet, the processing proceeds to Step S406 so that the sheet is excluded from the target for the downward movement processing of the stacker tray 72.

In Step S402, in a case where a plurality of sheets are included in the processing unit as the post-processing target, and the sheets are pulled into the compile tray 13, the controller 7 determines whether the first sheet is designated for the Z-folding processing, or whether the first sheet is Z-folded. In a case where the first sheet is designated for the Z-folding processing or is Z-folded, the processing proceeds to Step S403. Ina case where the sheet is not Z-folded, the processing proceeds to Step S406 so that the sheet is excluded from the target for the downward movement processing of the stacker tray 72.

In Step S403, the controller 7 determines whether the discharge destination of the sheet is the stacker tray 72. In a case where the discharge destination is the stacker tray 72, the processing proceeds to Step S404. In a case where the discharge destination is not the stacker tray 72, the processing proceeds to Step S406 so that the sheet is excluded from the target for the downward movement processing of the stacker tray 72.

Figure 5:
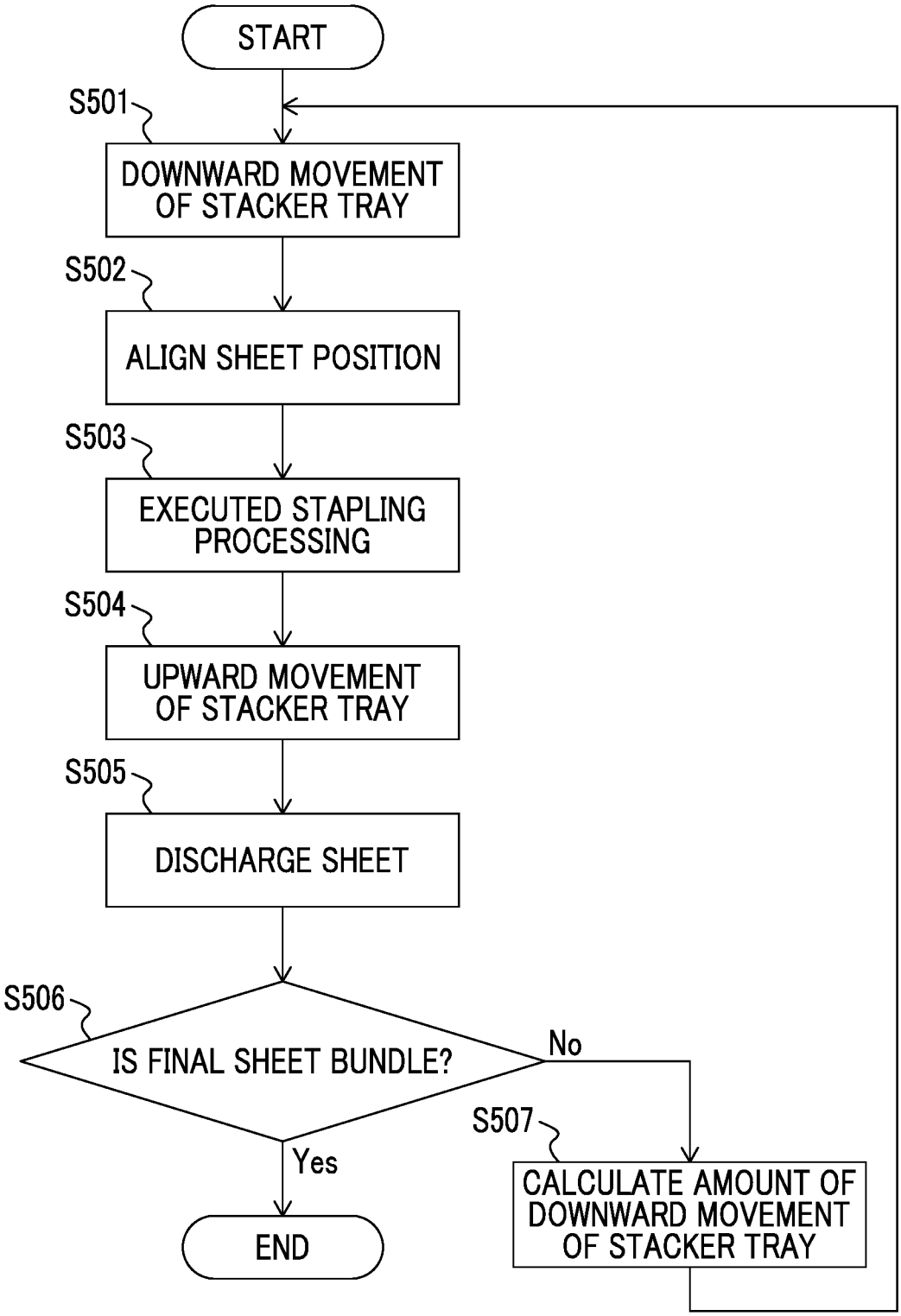
FIG. 5 is a flowchart showing a flow of the downward movement processing of the stacker tray according to the exemplary embodiment.

In Step S404, it is determined whether the sheet is set to be subjected to the staple processing. In a case where the sheet is set to be subjected to the staple processing, the downward movement processing of the stacker tray 72 shown in FIG. 5 is executed. In a case where the sheet is not set to be subjected to the staple processing, the processing proceeds to Step S406 so that the sheet is excluded from the target for the downward movement processing of the stacker tray 72.

Next, with reference to FIG. 5, the flow of the downward movement processing of the stacker tray 72 and the staple processing in the exemplary embodiment will be described. In Step S501 of FIG. 5, the controller 7 rotationally drives the motor 79 in the forward direction to move the stacker tray 72 downward by a predetermined distance. The amount of downward movement may be changed according to the size, material, and thickness of the sheet S. For example, the thinner the thickness of the sheet S, the easier it is for the angle of the second fold SB from the front end in the transport direction to be increased, and the easier it is for the sheet to be caught by the housing of the finisher 5, so that the amount of the downward movement is increased as compared with the thick sheet S. These downward movement amounts may be the amounts directly designated by the operator.

As shown in FIG. 3B, the rear end of the sheet S in the transport direction is raised from the upper surface of the loading platform 13*a* of the compile tray 13 and does not reach the end guide 13*b*. In this case, the downward movement processing is performed so that the stacker tray 72 is moved downward to a position where a portion from the rear end of the sheet S in the transport direction to the fold SB on the rear end side in the transport direction, that is, the second fold SB from the front end side in the transport direction is parallel to the upper surface of the loading platform 13*a*.

In the exemplary embodiment, the downward movement processing of the stacker tray 72 is performed in the case of the sheet having a predetermined size and the predetermined setting, but the downward movement processing of the stacker tray 72 may be performed in a case where the rear end of the sheet S in the transport direction has not reached the end guide 13*b* or has not reached the staple processing by detecting whether the rear end of the Z-folded sheet S in the transport direction has reached the end guide 13*b* of the compile tray 13 using the sensor.

As described above, in a case where the sheet S having a relatively long feed length is Z-folded, the fold SA on the front end side of the sheet S in the transport direction is not on the loading platform of the compile tray 13, but protrudes on the stacker tray 72. This state may be detected by a sensor (not shown) or detected by the calculation based on the length along the transport direction of the sheet, and the downward movement processing of the stacker tray 72 may be performed in such a case.

In Step S502, the controller 7 rotates the paddle 15 to pull the sheet S in the second traveling direction S2 such that the rear end of the sheet S in the transport direction reaches the end guide 13*b* of the compile tray 13. As described above, since the first fold SA on the front end side of the sheet S in the transport direction is moved downward together with the stacker tray 72, the force with which the first fold SA pulls the sheet S toward the stacker tray 72 becomes small. Therefore, the rear end of the sheet S in the transport direction is moved so as to reach the end guide 13*b* of the compile tray 13. Further, the end face of the sheet S, which is parallel to the transport direction is aligned by the tamper 16. That is, the end face of the sheet S, which is parallel to the transport direction is pushed to the side guide 13*c* of the compile tray 13 by the tamper 16. As a result, the rear ends in the transport direction and the side ends of the sheets S placed on the loading platform 13*a* of the compile tray 13 are aligned.

In Step S503, the controller 7 moves the base 17*b* and the staple head 17*a* of the stapler 17 to a desired position around the compile tray 13 along the rail 17*c*, and controls the staple head 17*a* to execute the staple processing on the sheet S.

In Step S504, the controller 7 rotationally drives the motor 79 in a direction opposite to the direction in Step S501 to move the stacker tray 72 upward by a predetermined distance by the lifting drive device 73. In this case, the distance of the upward movement of the stacker tray 72 is shorter than the distance of the downward movement in the case of moving the stacker tray 72 downward in Step S501. That is, the height in the case of raising the stacker tray 72 again is set to be lower than a normal position before the stacker tray 72 is moved downward, by a preset amount. As a result, the interference of the upper surface of the sheet bundle with a fixed tray located above the stacker tray 72 is avoided in a case where the sheet bundle is discharged to the stacker tray 72.

In Step S505, the controller 7 swings the driven-side discharge roll 18*b* of the discharge roll 18 to the contact position where the driven-side discharge roll 18*b* contacts the upper surface of the sheet, and then drives the drive-side discharge roll 18*a*. As a result, the stapled sheet bundle loaded on the loading platform 13*a* of the compile tray 13 is moved in the direction S3 of FIG. 2 in accordance with the rotation of the discharge roll 18, passes through the opening 71, and is discharged onto the stacker tray 72.

In Step S506, the controller 7 determines whether the sheet bundle discharged in Step S505 is the last sheet bundle, and in a case where the sheet bundle is the last sheet bundle, the processing is ended. In a case where the sheet bundle is not the last sheet bundle, that is, in a case where there is a sheet to be processed following the discharged sheet bundle, the processing proceeds to Step S507.

In Step S507, the controller 7 calculates the amount of the downward movement of the stacker tray 72 according to the number of Z-folds of the discharged sheet bundle, the processing returns to Step S501, the controller 7 moves the stacker tray 72 downward by the calculated amount of downward movement, and Steps S501 to S506 described above are repeatedly performed until all the processed bundles are discharged.

The controller 7 includes a CPU, a memory, a storage device, and a communication interface (which are not shown). The CPU is a control microprocessor, and controls the operations of the staple function unit 10, the sheet loading function unit 70, and each of other units based on a control program stored in the storage device.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing apparatus comprising:

a processing unit configured to pull in a recording medium transported from an upstream apparatus and perform in processing on the recording medium;

a discharge unit to which the recording medium processed by the processing unit is discharged; and a lifting drive device configured to, in a case where a folded recording medium is pulled into the processing unit, move the discharge unit downward such that a height of the discharge unit is lower than a height of the discharge unit in a case where an unfolded recording medium is pulled into the processing unit, wherein the lifting drive device moves the discharge unit downward in a case where a rear end of the folded recording medium in a transport direction has not been reached a processing position of the processing unit.

2. The post-processing apparatus according to claim 1, wherein in a case where a plurality of recording mediums are pulled into the processing unit and a first recording medium of the plurality of recording mediums is the folded recording medium, the lifting drive device moves the discharge unit downward.

3. The post-processing apparatus according to claim 1, wherein the lifting drive device moves the discharge unit downward to a position where a portion from a rear end of the folded recording medium in a transport direction to a fold on the rear end side in the transport direction is parallel to a placement surface of the processing unit.

4. The post-processing apparatus according to claim 2, wherein the lifting drive device moves the discharge unit downward to a position where a portion from a rear end of the folded recording medium in a transport direction to a fold on the rear end side in the transport direction is parallel to a placement surface of the processing unit.

5. The post-processing apparatus according to claim 1, wherein the lifting drive device changes an amount of downward movement of the discharge unit according to a thickness of the recording medium.

6. The post-processing apparatus according to claim 2, wherein the lifting drive device changes an amount of downward movement of the discharge unit according to a thickness of the recording medium.

7. The post-processing apparatus according to claim 3, wherein the lifting drive device changes an amount of downward movement of the discharge unit according to a thickness of the recording medium.

8. The post-processing apparatus according to claim 4, wherein the lifting drive device changes an amount of downward movement of the discharge unit according to a thickness of the recording medium.

9. The post-processing apparatus according to claim 1, wherein the lifting drive device moves the discharge unit upward in a case where the processed recording medium is discharged to the discharge unit.

* * * * *